US010577927B2

(12) United States Patent
Odegbami et al.

(10) Patent No.: US 10,577,927 B2
(45) Date of Patent: Mar. 3, 2020

(54) MUD PULSE TELEMETRY TOOL COMPRISING A LOW TORQUE VALVE

(71) Applicant: Halliburton Energy Services, Inc., Houston, TX (US)

(72) Inventors: Olumide O. Odegbami, Houston, TX (US); Larry DeLynn Chambers, Kingwood, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 155 days.

(21) Appl. No.: 15/758,120

(22) PCT Filed: Oct. 21, 2015

(86) PCT No.: PCT/US2015/056683
§ 371 (c)(1),
(2) Date: Mar. 7, 2018

(87) PCT Pub. No.: WO2017/069751
PCT Pub. Date: Apr. 27, 2017

(65) Prior Publication Data
US 2019/0383138 A1 Dec. 19, 2019

(51) Int. Cl.
*E21B 47/18* (2012.01)
*E21B 34/06* (2006.01)
*E21B 49/00* (2006.01)

(52) U.S. Cl.
CPC ..... *E21B 47/18* (2013.01); *E21B 34/06* (2013.01); *E21B 49/00* (2013.01)

(58) Field of Classification Search
None
See application file for complete search history.

(56) References Cited

U.S. PATENT DOCUMENTS

| | | | | |
|---|---|---|---|---|
| 2,847,020 | A | 8/1958 | Anderson et al. | |
| 4,785,300 | A | 11/1988 | Chin et al. | |
| 4,847,815 | A | 7/1989 | Malone | |
| 5,787,052 | A | 7/1998 | Gardner et al. | |
| 6,219,301 | B1 * | 4/2001 | Moriarty | E21B 47/182 367/84 |
| 6,626,253 | B2 | 9/2003 | Hahn et al. | |
| 6,714,138 | B1 | 3/2004 | Turner et al. | |

(Continued)

FOREIGN PATENT DOCUMENTS

| | | | |
|---|---|---|---|
| EP | 0140788 | A2 | 5/1985 |
| EP | 2743448 | A1 | 6/2014 |

(Continued)

OTHER PUBLICATIONS

International Preliminary Report on Patentability issued in related PCT Application No. PCT/US2015/056683 dated May 3, 2018 (11 pages).
International Search Report and Written Opinion issued in related PCT Application No. PCT/US2015/056683 dated Jul. 12, 2016, 14 pages (Continued)

*Primary Examiner* — Thomas S McCormack
(74) *Attorney, Agent, or Firm* — Alan Bryson; Baker Botts L.L.P.

(57) ABSTRACT

According to one embodiment, a mud pulse telemetry tool includes a body having a channel, a motor, and a valve coupled to the motor and disposed within the channel. The valve includes a plurality of lobes, with at least one of the plurality of lobes having a cavity formed therein.

12 Claims, 4 Drawing Sheets

(56) References Cited

U.S. PATENT DOCUMENTS

| | | | |
|---|---|---|---|
| 6,970,398 | B2 | 11/2005 | Lavrut et al. |
| 7,468,679 | B2 | 12/2008 | Feluch |
| 8,514,657 | B2 | 8/2013 | Sitka |
| 8,693,284 | B2 | 4/2014 | Allan et al. |
| 8,811,118 | B2 | 8/2014 | Reckmann |
| 9,000,939 | B2 | 4/2015 | Sitka et al. |
| 2006/0034154 | A1 | 2/2006 | Perry et al. |
| 2009/0016160 | A1 | 1/2009 | Wasserman et al. |
| 2010/0157735 | A1 | 6/2010 | Allan et al. |
| 2011/0280105 | A1 | 11/2011 | Hall et al. |
| 2013/0076527 | A1 | 3/2013 | Sitka et al. |
| 2013/0277119 | A1 | 10/2013 | Rogers et al. |
| 2014/0307527 | A1 | 10/2014 | Sitka |

FOREIGN PATENT DOCUMENTS

| | | | |
|---|---|---|---|
| WO | 0229441 | A1 | 4/2002 |
| WO | 2014071519 | A1 | 5/2014 |
| WO | 2014131125 | A1 | 9/2014 |

OTHER PUBLICATIONS

APS Technology, White Paper, "SureShot-MP: Rotary Pulser—Fixed-mount or Retrievable Positive Mud Pulse Transmitter", Rev. 151229-vD, 2015, 2 pages.

Search report issued in related EP Application No. 15906833.7 dated Mar. 1, 2019, 6 pages.

Search report issued in related Russian application No. 2018109740, dated Feb. 13, 2019, 3 pages.

* cited by examiner

MUD PULSE TELEMETRY TOOL COMPRISING A LOW TORQUE VALVE

CROSS-REFERENCE TO RELATED APPLICATION

The present application is a U.S. National Stage Application of International Application No. PCT/US2015/056683 filed Oct. 21, 2015, which is incorporated herein by reference in its entirety for all purposes.

BACKGROUND

The present disclosure relates generally to mud pulse telemetry in downhole drilling applications and, more particularly, to a mud pulse telemetry tool comprising a valve with low torque characteristics.

Drilling requires the acquisition of many disparate data streams, including mud pulse telemetry data. Mud may refer to the drilling fluid used when drilling wellbores for hydrocarbon recovery. During operations, mud may be pumped down the drill string and through the drill bit to provide cooling and lubrication to the area surrounding the drill bit. Drilling systems may use valves to modulate the flow of the mud through the drill string, which may generate pressure pulses that propagate up the column of drilling fluid. These pressure pulses are referred to as mud pulses, and may be encoded data associated with the drilling operation for communication uphole to operators and/or data collection systems.

BRIEF DESCRIPTION OF THE DRAWINGS

For a more complete understanding of the present disclosure and its features and advantages, reference is now made to the following description, taken in conjunction with the accompanying drawings, in which.

While embodiments of this disclosure have been depicted and described and are defined by reference to example embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

The present disclosure describes to a mud pulse telemetry tool comprising a valve with low torque characteristics. In particular, the present disclosure describes a low torque valve of a mud pulse generator for use in downhole mud pulse telemetry tools, and an associated configuration of a mud pulse telemetry tool that may result in more efficient power usage. When performing subterranean operations, real time data needs to be communicated uphole for use in making drilling decisions. One way of doing this is through the use of mud pulse telemetry. As drilling fluid (referred to as "mud") is pumped downhole toward the drill bit for cooling and lubrication, one or more valves may be used to modulate the flow of the mud. This modulation generates pressure pulses (referred to as mud pulses) that propagate up the column of drilling fluid inside the wellbore. These pulses may modulated such that they are encoded data associated with the drilling operation.

Figure 3A:
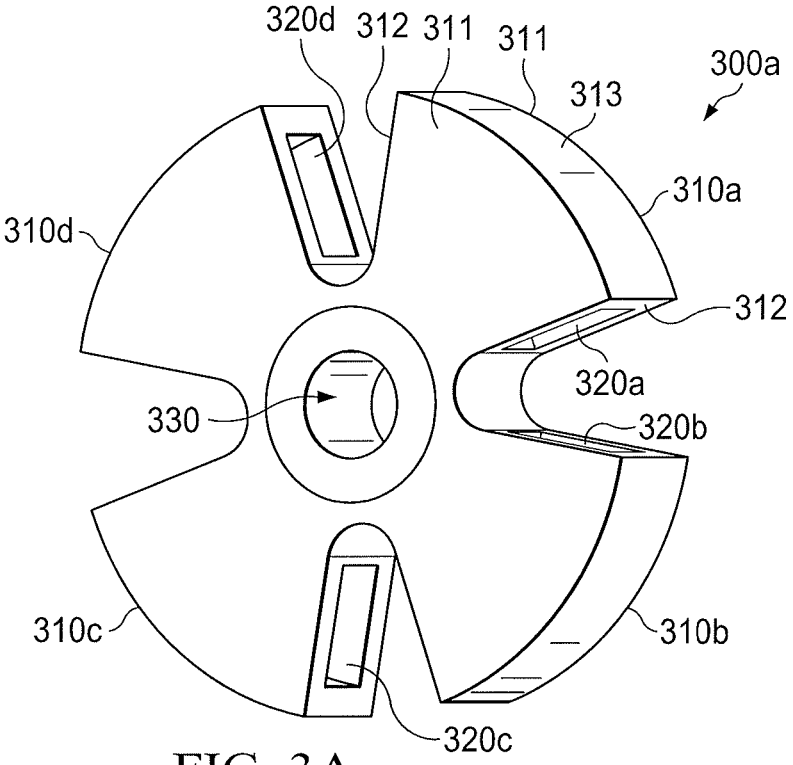
FIGS. 3A-3B illustrate example mud pulse generator valves in accordance with embodiments of the present disclosure.
Figure 3B:
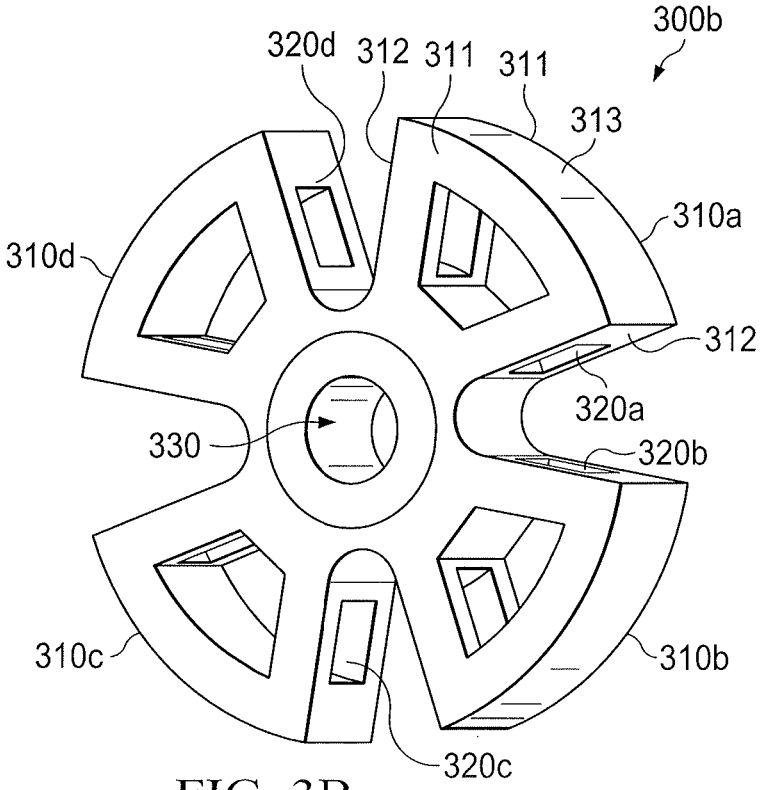

A mud pulse generator valve in accordance with the present disclosure may be similar to a mud siren valve, but may include cavities in one or more portions of the valve in order to reduce the valve's mass and moment of inertia. The mud pulse generator valve may include any number of lobes, with certain or all of the lobes having a cavity formed therein. The lobes of the valve may be generally arcuate-shaped, and the valve may have generally arcuate-shaped channels formed between adjacent lobes. The lobes may be defined by front and back planar surfaces, a pair of oppositely-disposed side surfaces, and a generally arcuate-shaped top surface disposed between the front and back planar surfaces. The cavities may be formed between each of the surfaces of the lobe, in certain embodiments. For example, the cavity may be formed in the lobes of the valve as illustrated in FIGS. 3A-3B. Further, in particular embodiments, one or both of the oppositely-disposed side surfaces may be defined by openings, and/or openings may be formed each one or both of the front and back planar surfaces. With mud pulse generator valves designed according to the present disclosure, the amount of torque required to rotate the valve is reduced, which in turn reduces the amount of power required to produce mud pulses in downhole mud pulse telemetry tools.

Accordingly, mud pulse telemetry tools in accordance with the present disclosure may allow for a more advanced mud pulse control system due to sensitivity of pressure to stroke angle, especially as the number of lobes on the mud pulse generator valve decreases. The mud pulse generator valve may be rotated using any suitable downhole motor, including a hydraulic actuator or an electric motor. Mud pulse generator valves according to the present disclosure may have any suitable seal configuration, including O-ring seals or rotary seals. In certain embodiments, no seal may be required.

In addition to lower torque and power requirements, mud pulse generator valves according to the present disclosure may allow for adjustable valve placement in valve system designs, which may allow for increased valve life due to less high velocity erosion on the valve. Furthermore, mud pulse generator valves according to the present disclosure may allow for lower fluidic torque, since the cavities in the valve (or the design of the mud pulse telemetry tool) may reduce the lobe contact area with the drilling fluid, resulting in less radial fluidic torque. Also, because the fluid flow is away and in the downhole direction, axial fluid load on the mud pulse generator valve may be decreased when compared to traditional mud siren valves.

Mud pulse generator valves according to the present disclosure may thus allow for increased mud pulse telemetry speed, leading to quicker transmission of real-time downhole data, increased operational efficiency for the mud pulse telemetry tool (which may be due to high frequency valve operation with a lower power requirement), and/or improved speed and efficiency in performing logging-while-drilling (LWD) operations.

To facilitate a better understanding of the present disclosure, the following examples of certain embodiments are given. In no way should the following examples be read to limit, or define, the scope of the disclosure. Embodiments of the present disclosure and its advantages are best understood by referring to FIGS. 1 through 3, where like numbers are used to indicate like and corresponding parts.

Figure 1:
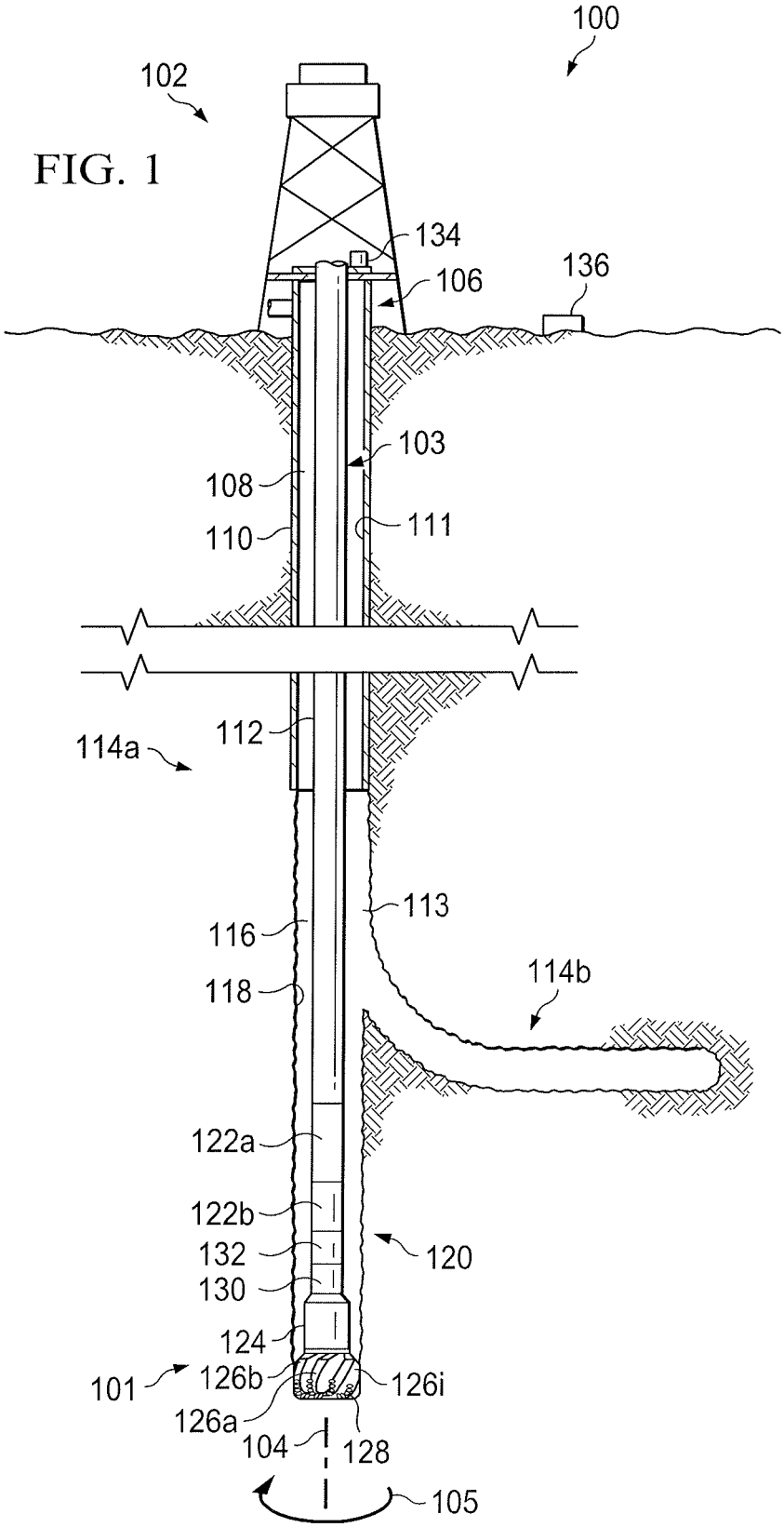
FIG. 1 illustrates an elevation view of an example embodiment of drilling system used in an illustrative logging-while-drilling (LWD) environment, in accordance with embodiments of the present disclosure.

FIG. 1 illustrates an elevation view of an example embodiment of drilling system 100 used in an illustrative logging-while-drilling (LWD) environment, in accordance with embodiments of the present disclosure. Modern petroleum drilling and production operations use information relating to parameters and conditions downhole. Several methods exist for collecting downhole information during subterranean operations, including LWD. In LWD, data is typically collected during a drilling process, thereby avoiding any need to remove the drilling assembly to insert a wireline logging tool. LWD consequently allows an operator of a drilling system to make accurate real-time modifications or corrections to optimize performance while minimizing down time.

Drilling system 100 may include well surface or well site 106. Various types of drilling equipment such as a rotary table, drilling fluid (i.e., mud) pumps and drilling fluid tanks (not expressly shown) may be located at well surface or well site 106. For example, well site 106 may include drilling rig 102 that may have various characteristics and features associated with a "land drilling rig." However, downhole drilling tools incorporating teachings of the present disclosure may be satisfactorily used with drilling equipment located on offshore platforms, drill ships, semi-submersibles, and drilling barges (not expressly shown).

Drilling system 100 may also include drill string 103 associated with drill bit 101 that may be used to form a wide variety of wellbores or bore holes such as generally vertical wellbore 114*a* or generally horizontal 114*b* wellbore or any other angle, curvature, or inclination. Various directional drilling techniques and associated components of bottom hole assembly (BHA) 120 of drill string 103 may be used to form horizontal wellbore 114*b*. For example, lateral forces may be applied to BHA 120 proximate kickoff location 113 to form generally horizontal wellbore 114*b* extending from generally vertical wellbore 114*a*. The term "directional drilling" may be used to describe drilling a wellbore or portions of a wellbore that extend at a desired angle or angles relative to vertical. The desired angles may be greater than normal variations associated with vertical wellbores. Direction drilling may also be described as drilling a wellbore deviated from vertical. The term "horizontal drilling" may be used to include drilling in a direction approximately ninety degrees (90°) from vertical but may generally refer to any wellbore not drilled only vertically. "Uphole" may be used to refer to a portion of wellbore 114 that is closer to well surface 106 via the path of the wellbore 114. "Downhole" may be used to refer to a portion of wellbore 114 that is further from well surface 106 via the path of wellbore 114.

BHA 120 may be formed from a wide variety of components configured to form wellbore 114. For example, components 122*a* and 122*b* of BHA 120 may include, but are not limited to, drill bits (e.g., drill bit 101), coring bits, drill collars, rotary steering tools, directional drilling tools, downhole drilling motors, reamers, hole enlargers or stabilizers. The number and types of components 122 included in BHA 120 may depend on anticipated downhole drilling conditions and the type of wellbore that will be formed by drill string 103 and rotary drill bit 101. BHA 120 may also include various types of well logging tools and other downhole tools associated with directional drilling of a wellbore. Examples of logging tools and/or directional drilling tools may include, but are not limited to, acoustic, neutron, gamma ray, density, photoelectric, nuclear magnetic resonance, induction, resistivity, caliper, coring, seismic, rotary steering, and/or any other commercially available well tools. Further, BHA 120 may also include a rotary drive (not expressly shown) connected to components 122*a* and 122*b* and which rotates at least part of drill string 103 together with components 122*a* and 122*b*.

Drilling system 100 may also include a logging tool 130 and telemetry sub 132 integrated with BHA 120 near drill bit 101 (e.g., within a drilling collar, for example a thick-walled tubular that provides weight and rigidity to aid in the drilling process, or a mandrel). In certain embodiments, drilling system 100 may include control unit 134, positioned at the surface, in drill string 103 (e.g., in BHA 120 and/or as part of logging tool 130), or both (e.g., a portion of the processing may occur downhole and a portion may occur at the surface). Control unit 134 may include an information handling system and/or a control algorithm for logging tool 130, telemetry sub 132, or other components of BHA 120. Control unit 134 may be communicatively coupled to logging tool 130 and/or telemetry sub 132, in certain embodiments, or may be a component of either. In certain embodiments, the information handling system of control unit 134 (e.g., through an algorithm) may cause control unit 134 to generate and transmit control signals to one or more elements of logging tool 130 or telemetry sub 132.

Logging tool 130 may include receivers (e.g., antennas) and/or transmitters capable of receiving and/or transmitting one or more acoustic signals. The transmitter may include any type of transmitter suitable for generating an acoustic signal, such as a solenoid or piezoelectric shaker. In some embodiments, logging tool 130 may include a transceiver array that functions as both a transmitter and a receiver. A drive signal may transmitted by control unit 134 to logging tool 130 to cause logging tool 130 to emit an acoustic signal. As the bit extends wellbore 114 through the formations, logging tool 130 may collect measurements relating to various formation properties as well as the tool orientation and position and various other drilling conditions. The orientation measurements may be performed using an azimuthal orientation indicator, which may include magnetometers, inclinometers, and/or accelerometers, though other sensor types such as gyroscopes may be used in some embodiments. In some embodiments, logging tool 130 may include sensors to record the environmental conditions in wellbore 114, such as the ambient pressure, ambient temperature, the resonance frequency, or the phase of the vibration.

Telemetry sub 132 may be included on drill string 103 to transfer tool measurements (e.g., measurements of logging tool 130) to surface receiver 136 and/or to receive commands from control unit 134 (when control unit 134 is at least partially located on the surface). For example, telemetry sub 132 may transmit data through one or more wired or wireless communications channels (e.g., wired pipe or electromagnetic propagation). As another example, telemetry sub 132 may transmit data as a series of pressure pulses or modulations within a flow of drilling fluid as described herein, or as a series of acoustic pulses that propagate to the surface through a medium, such as the drill string.

Drilling system 100 may also include facilities (not expressly shown) that may include computing equipment configured to collect, process, and/or store the measurements received from logging tool 130, telemetry sub 132, and/or surface receiver 136. The facilities may be located onsite or offsite.

Wellbore 114 may be defined in part by casing string 110 that may extend from well surface 106 to a selected downhole location. Portions of wellbore 114, as shown in FIG. 1, that do not include casing string 110 may be described as "open hole." Various types of drilling fluid (also referred to as "mud") may be pumped from well surface 106 through drill string 103 to attached drill bit 101. The drilling fluids may be directed to flow from drill string 103 to respective nozzles passing through rotary drill bit 101. The drilling fluid may be circulated back to well surface 106 through annulus 108 defined in part by outside diameter 112 of drill string 103 and inside diameter 118 of wellbore 114. Inside diameter 118 may be referred to as the "sidewall" of wellbore 114. Annulus 108 may also be defined by outside diameter 112 of drill string 103 and inside diameter 111 of casing string 110. Open hole annulus 116 may be defined as sidewall 118 and outside diameter 112.

Drilling system 100 may also include rotary drill bit ("drill bit") 101. Drill bit 101 may include one or more blades 126 that may be disposed outwardly from exterior portions of rotary bit body 124 of drill bit 101. Blades 126 may be any suitable type of projections extending outwardly from rotary bit body 124. Drill bit 101 may rotate with respect to bit rotational axis 104 in a direction defined by directional arrow 105. Blades 126 may include one or more cutting elements 128 disposed outwardly from exterior portions of each blade 126. Blades 126 may also include one or more depth of cut controllers (not expressly shown) configured to control the depth of cut of cutting elements 128. Blades 126 may further include one or more gage pads (not expressly shown) disposed on blades 126. Drill bit 101 may be designed and formed in accordance with teachings of the present disclosure and may have many different designs, configurations, and/or dimensions according to the particular application of drill bit 101.

Modifications, additions, or omissions may be made to FIG. 1 without departing from the scope of the present disclosure. For example, FIG. 1 illustrates components of drilling system 100 in a particular configuration. However, any suitable configuration of components may be used. Furthermore, fewer or additional components may be included in drilling system 100 without departing from the scope of the present disclosure.

Figure 2A:
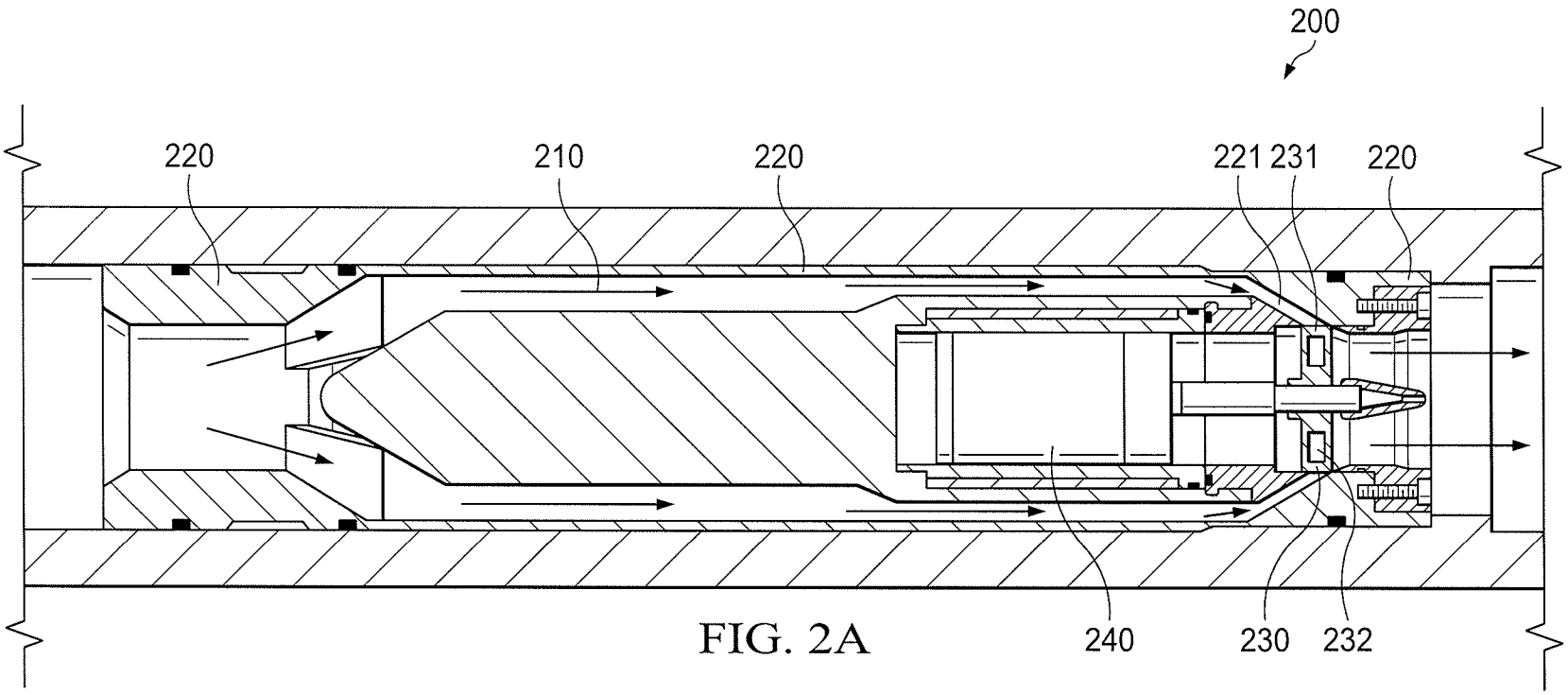
FIGS. 2A-2B illustrate perspective views of an example mud pulse telemetry tool in accordance with embodiments of the present disclosure.
Figure 2B:
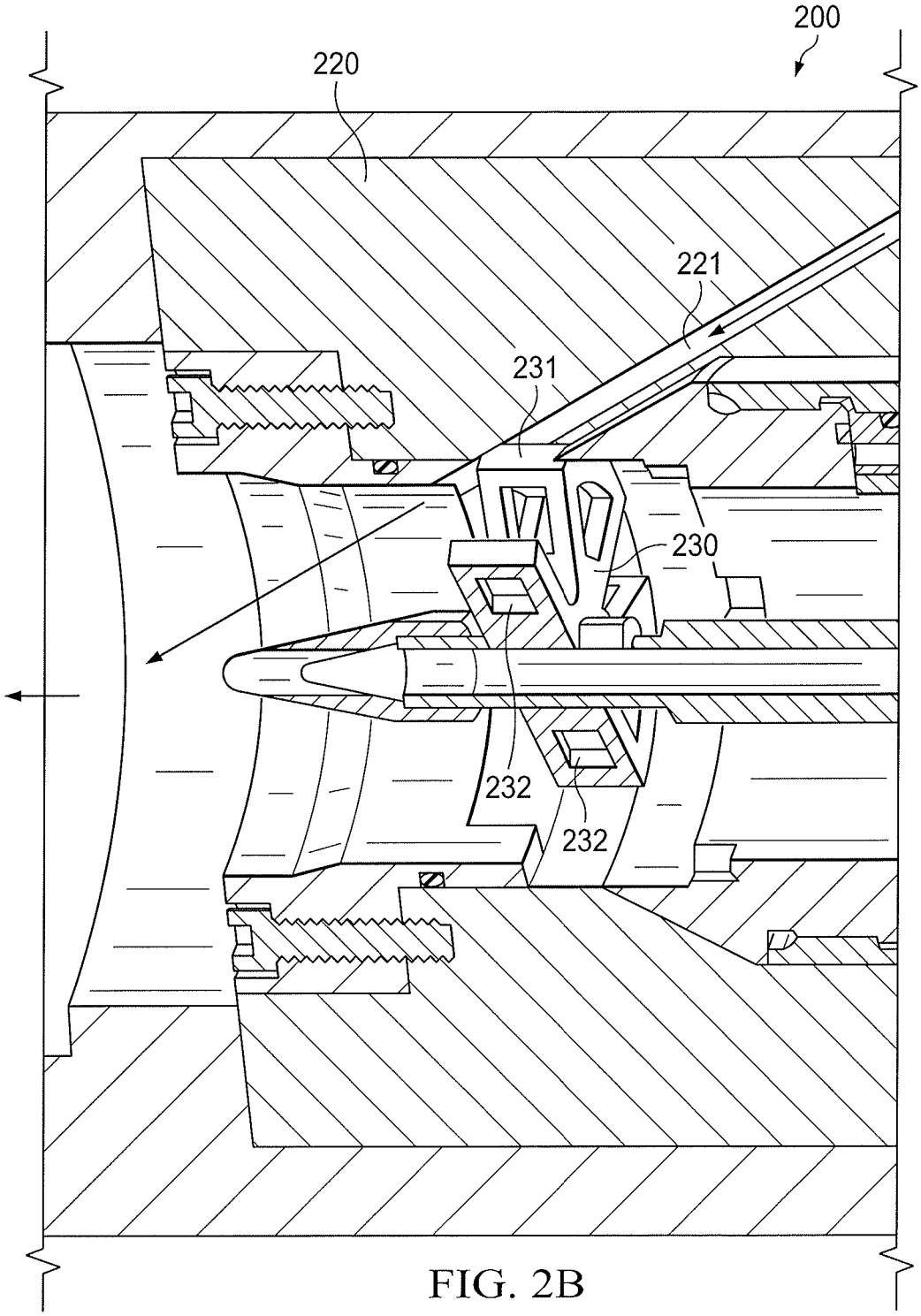

FIGS. 2A-2B illustrate perspective views of an example mud pulse telemetry tool 200 in accordance with embodiments of the present disclosure. Mud pulse telemetry tool 200 may be coupled to a portion of a drill string of a drilling system, in certain embodiments, similar to telemetry sub 132 of drilling system 100 of FIG. 1. For example, mud pulse telemetry tool 200 may be coupled (physically and/or communicably) to a logging tool of a drilling system, and may be configured to encode mud pulses with data associated with the logging tool. One or more channels, such as channel 221, may be formed in body 220 of mud pulse telemetry tool 200, such that drilling fluid 210 flows through the channels as it moves downhole (i.e., towards the right of FIG. 2A and left of FIG. 2B). To generate mud pulses as described above, drilling fluid 210 may flow through channel 221 and be directed toward valve 230, which may be controlled by motor 240 in such a way that causes valve 230 to selectively block, inhibit, or fully allow the flow of drilling fluid 210 through the channel 221. Valve 230 may be a mud pulse generator valve having low torque characteristics in accordance with the present disclosure, such as a mud pulse generator valve with lobes 231 with cavities 232 formed therein. For example, valve 230 may be a mud pulse generator valve similar to valves 300 illustrated in FIGS. 3A-3B and described further below.

In operation, drilling fluid 210 may flow down a drill string and through channels in body 220 of mud pulse telemetry tool 200 before being directed toward valve 230 by channel 221. Valve 230 may be coupled to motor 240 by a shaft as illustrated, with valve 230 being modulated (e.g., rotated and/or oscillated) by motor 240 in order to encode mud pulses for use in downhole telemetry. For example, valve 230 may be rotated to selectively block or allow the flow of drilling fluid 210 downhole, creating encoded mud pulses that propagate uphole through drilling fluid 210 in the drill string of the drilling system. That is, when a lobe 231 of valve 230 is in the same position as channel 221, as shown in FIG. 2B, the flow of drilling fluid 210 may be restricted (in whole or in part), creating an increase in uphole pressure in the drilling fluid. Conversely, when the position of the lobe 231 of valve 230 is changed such that it is located away from the channel 221, the restriction in the flow of drilling fluid 210 is removed and the uphole pressure decreases. Modulating valve 230 between these states may result in mud pulses having binary encoding (i.e., the pulses have one of two amplitude values). In certain embodiments, however, motor 240 may also be operable to oscillate valve 230 in the uphole-downhole direction (i.e., left to right in FIG. 2A) such that an amplitude of mud pulses may be further encoded beyond the binary scheme described above. For example, in such embodiments, the mud pulses may be encoded by amplitude modulation techniques.

Modifications, additions, or omissions may be made to FIGS. 2A-2B without departing from the scope of the present disclosure. For example, FIGS. 2A-2B illustrate components of mud pulse telemetry tool 200 in a particular configuration that directs the flow of drilling fluid 210 toward valve 230 in a relatively diagonal direction due to valve 230 having openings formed in the front and back planar surfaces of lobes 231 (similar to valve 300*b* of FIG. 3B). However, any suitable configuration may be used, such as one that includes a valve 230 with solid front and back planar surfaces wherein only the oppositely-disposed side surfaces of lobes 231 have openings formed therein (similar to valve 300*a* of FIG. 3A), and the flow of drilling fluid 210 is directed toward the front planar surface of valve 230. Furthermore, fewer or additional components may be included in mud pulse telemetry tool 200 without departing from the scope of the present disclosure.

FIGS. 3A-3B illustrate example mud pulse generator valves 300 in accordance with embodiments of the present disclosure. Mud pulse generator valves 300 may be coupled to a motor inside a mud pulse telemetry tool, in certain embodiments (similar to valve 230 coupled to motor 240 of mud pulse telemetry tool 200 of FIGS. 2A-2B). Valves 300 may be coupled to the motor using a shaft connected via shaft coupler 330. Mud pulse generator valves 300 comprise a plurality of lobes 310, which may selectively block, inhibit, or allow the flow of drilling fluid as described above when the valves 300 are modulated (e.g., rotated or oscillated) by a motor in a mud pulse telemetry tool. Lobes 310 may be generally arcuate-shaped, and valve 300 may have generally arcuate-shaped channels formed between adjacent lobes 310. Lobes 310 may be defined by front and back planar surfaces, a pair of oppositely-disposed side surfaces, and a generally arcuate-shaped top surface disposed between the front and back planar surfaces. For example, referring to lobe 310*a* of FIG. 3A, lobe 310*a* may be defined by front and back planar surfaces 311, oppositely-disposed side surfaces 312, and generally arcuate-shaped top surface 313.

Each lobe 310 may have a cavity 320 formed therein. In particular embodiments, cavities 320 may be formed between one or more surfaces defining lobe 310. Cavities 320 may aid in lowering the mass and moment of inertia of valves 300, which in turn lowers the amount of torque required to rotate valves 300 for modulation purposes (lowering the power required by the motor to modulate valves 300). Valves 300 may be configured in a mud pulse telemetry tool in any suitable configuration. For example, valves 300 may be configured similar to a typical mud siren valve, wherein the flow of drilling fluid is modulated by the front planar surfaces of lobes 310 (i.e., the flow of the drilling fluid is perpendicular to the front planar surfaces of lobes 310). Valve 300*a* of FIG. 3A illustrates an example valve that may be used in such embodiments. As another example, valves 300 may be configured similar to valve 230 of FIGS. 2A-2B, wherein the flow of drilling fluid is modulated by the generally arcuate-shaped top surface of lobes 310 (i.e., the flow of drilling fluid is not perpendicular to the front planar surfaces of lobes 310). Valve 300*b* of FIG. 3B illustrates an example valve that may be used in such embodiments.

Referring specifically to FIG. 3A, valve 300*a* comprises four lobes 310 with each lobe 310 having a cavity 320 formed therein. Cavities 320 of valve 300*a* are formed between the front planar surface, the back planar surface, the generally arcuate-shaped top surface and the pair of oppositely-disposed side surfaces of lobes 310. The front and back planar surfaces and the generally arcuate-shaped top surface of lobes 310 of valve 300 are solid, while the pair of oppositely-disposed side surfaces have openings formed therein. Accordingly, valve 300*a* may be used in mud pulse telemetry tools that either direct drilling fluid toward the front planar surfaces of lobes 310 (e.g., those used with typical mud siren valves), or in tools that direct drilling fluid toward the generally arcuate-shaped top surfaces of lobes 310.

Similar to valve 300*a* of FIG. 3A, valve 300*b* of FIG. 3B comprises four lobes 310 with each lobe 310 having a cavity 320 formed therein. Cavities 320 of valve 300*b* are similarly formed between the front planar surface, the back planar surface, the generally arcuate-shaped top surface and the pair of oppositely-disposed side surfaces of lobes 310. In contrast to valve 300*a*, however, both the front and back planar surfaces and the oppositely-disposed side surfaces of lobes 310 have openings formed therein, with the generally arcuate-shaped top surface of lobes 310 remaining solid. Accordingly, valve 300*b* may be more preferable in tools that direct drilling fluid toward the generally arcuate-shaped top surfaces of lobes 310 rather than the front planar surfaces of lobes 310.

Modifications, additions, or omissions may be made to FIGS. 3A-3B without departing from the scope of the present disclosure. For example, FIGS. 3A-3B illustrate mud pulse generator valves 300 with particular configurations of lobes 310 having cavities formed therein. However, any suitable configuration of cavities may be used for lowering the mass and moment of inertia of mud pulse generator valves. As one example, only certain lobes 310 of the valves 300 may have cavities 320 formed therein rather than each lobe 310 as illustrated in FIGS. 3A-3B. As another example, openings may be formed in only certain of the front and/or back planar surfaces of each lobe 310, rather than both as illustrated in FIG. 3B. As yet another example, the generally arcuate-shaped top surface of lobe 310 may have an opening formed therein.

To provide illustrations of one or more embodiments of the present disclosure, the following examples are provided.

In one or more embodiments, a system includes a logging tool and a mud pulse telemetry tool coupled to the logging tool. The mud pulse telemetry tool includes a body having a channel, a motor, and a valve coupled to the motor and disposed within the channel. The valve includes a plurality of lobes, with at least one of the plurality of lobes having a cavity formed therein.

In one or more embodiments described in the preceding paragraph, each lobe is generally arcuate-shaped.

In one or more embodiments described in the preceding two paragraphs, generally arcuate-shaped channels are formed between adjacent lobes.

In one or more embodiments described in the preceding three paragraphs, each lobe is defined by a front planar surface, a back planar surface, a generally arcuate-shaped top surface disposed between the front planar surface and the back planar surface, and a pair of oppositely-disposed side surfaces disposed between the front planar surface and the back planar surface.

In one or more embodiments described in the preceding four paragraphs, a cavity is formed between the front planar surface, the back planar surface, the generally arcuate-shaped top surface and pair of oppositely-disposed side surfaces in each of the plurality of lobes.

In one or more embodiments described in the preceding five paragraphs, openings are formed in each of the pair of oppositely-disposed side surfaces.

In one or more embodiments described in the preceding six paragraphs, openings are formed in each of the front planar surface and the back planar surface.

In one or more embodiments, a mud pulse telemetry tool includes a body having a channel, a motor, and a valve coupled to the motor and disposed within the channel. The valve includes a plurality of lobes, with at least one of the plurality of lobes having a cavity formed therein.

In one or more embodiments described in the preceding paragraph, each lobe is generally arcuate-shaped.

In one or more embodiments described in the preceding two paragraphs, generally arcuate-shaped channels are formed between adjacent lobes.

In one or more embodiments described in the preceding three paragraphs, each lobe is defined by a front planar surface, a back planar surface, a generally arcuate-shaped top surface disposed between the front planar surface and the back planar surface, and a pair of oppositely-disposed side surfaces disposed between the front planar surface and the back planar surface.

In one or more embodiments described in the preceding four paragraphs, a cavity is formed between the front planar surface, the back planar surface, the generally arcuate-shaped top surface and pair of oppositely-disposed side surfaces in each of the plurality of lobes.

In one or more embodiments described in the preceding five paragraphs, openings are formed in each of the pair of oppositely-disposed side surfaces.

In one or more embodiments described in the preceding six paragraphs, openings are formed in each of the front planar surface and the back planar surface.

In one or more embodiments, a mud pulse generator valve includes a plurality of lobes, with at least one of the plurality of lobes having a cavity formed therein.

In one or more embodiments described in the preceding paragraph, each lobe is generally arcuate-shaped.

In one or more embodiments described in the preceding two paragraphs, generally arcuate-shaped channels are formed between adjacent lobes.

In one or more embodiments described in the preceding three paragraphs, each lobe is defined by a front planar surface, a back planar surface, a generally arcuate-shaped top surface disposed between the front planar surface and the back planar surface, and a pair of oppositely-disposed side surfaces disposed between the front planar surface and the back planar surface.

In one or more embodiments described in the preceding four paragraphs, a cavity is formed between the front planar surface, the back planar surface, the generally arcuate-shaped top surface and pair of oppositely-disposed side surfaces in each of the plurality of lobes.

In one or more embodiments described in the preceding five paragraphs, openings are formed in each of the pair of oppositely-disposed side surfaces, and openings are formed in each of the front planar surface and the back planar surface.

The present disclosure is well-adapted to carry out the objects and attain the ends and advantages mentioned as well as those which are inherent therein. While the disclosure has been depicted and described by reference to exemplary embodiments of the disclosure, such a reference does not imply a limitation on the disclosure, and no such limitation is to be inferred. The disclosure is capable of considerable modification, alteration, and equivalents in form and function, as will occur to those ordinarily skilled in the pertinent arts and having the benefit of this disclosure. The depicted and described embodiments of the disclosure are exemplary only, and are not exhaustive of the scope of the disclosure. Consequently, the disclosure is intended to be limited only by the spirit and scope of the appended claims, giving full cognizance to equivalents in all respects. The terms in the claims have their plain, ordinary meaning unless otherwise explicitly and clearly defined by the patentee.

The terms "couple" or "couples" as used herein are intended to mean either an indirect or a direct connection. Thus, if a first device couples to a second device, that connection may be through a direct connection, or through an indirect mechanical or electrical connection via other devices and connections. Similarly, the term "communicatively coupled" as used herein is intended to mean either a direct or an indirect communication connection. Such connection may be a wired or wireless connection such as, for example, Ethernet or LAN. Such wired and wireless connections are well known to those of ordinary skill in the art and will therefore not be discussed in detail herein. Thus, if a first device communicatively couples to a second device, that connection may be through a direct connection, or through an indirect communication connection via other devices and connections.

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communication with external devices as well as various input and output (I/O) devices, such as a keyboard, a mouse, and a video display. The information handling system may also include one or more buses operable to transmit communications between the various hardware components.

For the purposes of this disclosure, computer-readable media may include any instrumentality or aggregation of instrumentalities that may retain data and/or instructions for a period of time. Computer-readable media may include, for example, without limitation, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such as wires, optical fibers, microwaves, radio waves, and other electromagnetic and/or optical carriers; and/or any combination of the foregoing.

What is claimed is:

1. A system, comprising:

a logging tool;

a mud pulse telemetry tool coupled to the logging tool, the mud pulse telemetry tool comprising:

a body having a channel;

a motor; and a valve coupled to the motor and disposed within the channel, the valve comprising a plurality of lobes;

wherein each lobe is defined by a front planar surface, a back planar surface, a generally arcuate-shaped top surface disposed between the front planar surface and the back planar surface, and a pair of oppositely-disposed side surfaces disposed between the front planar surface and the back planar surface;

wherein a cavity is formed between the front planar surface, the back planar surface, the generally arcuate-shaped top surface and pair of oppositely-disposed side surfaces in each of the plurality of lobes; and wherein openings are formed in each of the front planar surface and the back planar surface.

2. The system of claim 1, wherein each lobe is generally arcuate-shaped.

3. The system of claim 2, wherein generally arcuate-shaped channels are formed between adjacent lobes.

4. The system of claim 1, wherein openings are formed in each of the front planar surface and the back planar surface.

5. A mud pulse telemetry tool, comprising:

a body having a channel;

a motor; and a valve coupled to the motor and disposed within the channel, the valve comprising a plurality of lobes;

wherein each lobe is defined by a front planar surface, a back planar surface, a generally arcuate-shaped top surface disposed between the front planar surface and the back planar surface, and a pair of oppositely-disposed side surfaces disposed between the front planar surface and the back planar surface;

wherein a cavity is formed between the front planar surface, the back planar surface, the generally arcuate-shaped top surface and pair of oppositely-disposed side surfaces in each of the plurality of lobes; and wherein openings are formed in each of the front planar surface and the back planar surface.

6. The mud pulse telemetry tool of claim 5, wherein each lobe is generally arcuate-shaped.

7. The mud pulse telemetry tool of claim 6, wherein generally arcuate-shaped channels are formed between adjacent lobes.

8. The mud pulse telemetry tool of claim 5, wherein openings are formed in each of the front planar surface and the back planar surface.

9. A mud pulse generator valve, comprising:

a plurality of lobes;

wherein each lobe is defined by a front planar surface, a back planar surface, a generally arcuate-shaped top surface disposed between the front planar surface and the back planar surface, and a pair of oppositely-disposed side surfaces disposed between the front planar surface and the back planar surface;

wherein a cavity is formed between the front planar surface, the back planar surface, the generally arcuate-shaped top surface and pair of oppositely-disposed side surfaces in each of the plurality of lobes; and wherein openings are formed in each of the pair of oppositely-disposed side surfaces.

10. The mud pulse generator valve of claim 9, wherein each lobe is generally arcuate-shaped.

11. The mud pulse generator valve of claim 10, wherein generally arcuate-shaped channels are formed between adjacent lobes.

12. The mud pulse generator valve of claim 9, wherein opening are formed in each of the front planar surface and the back planar surface.

* * * * *